United States Patent [19]

Gazda

[11] Patent Number: 4,540,048

[45] Date of Patent: Sep. 10, 1985

[54] LOCKING DEVICE FOR WELL TOOLS

[75] Inventor: Imre I. Gazda, Fort Worth, Tex.

[73] Assignee: Otis Engineering Corporation, Dallas, Tex.

[21] Appl. No.: 604,384

[22] Filed: Apr. 27, 1984

[51] Int. Cl.[3] ..... E21B 23/00

[52] U.S. Cl. ..... 166/214; 166/217

[58] Field of Search ..... 166/214–217, 166/136

[56] References Cited

U.S. PATENT DOCUMENTS

| | | | |
|---|---|---|---|
| 2,673,614 | 3/1954 | Miller | 166/214 X |
| 2,856,003 | 10/1958 | Fredd | 166/214 |
| 2,862,564 | 12/1958 | Bostock | 166/214 |
| 3,148,894 | 9/1964 | Schwab | 166/214 |
| 3,208,531 | 9/1965 | Tamplen | 166/214 X |
| 3,419,075 | 12/1968 | Brown | 166/214 X |
| 3,472,070 | 10/1969 | Chenoweth | 166/214 X |
| 4,043,392 | 8/1977 | Gazda | 166/217 |

*Primary Examiner*—Stephen J. Novosad
*Assistant Examiner*—Thuy M. Bui
*Attorney, Agent, or Firm*—Albert W. Carroll

[57] ABSTRACT

An improved device for releasably anchoring a well tool, or the like, in a well conduit, the device having locking keys thereon which are spring-pressed outwardly, each key having a pair of oppositely facing abrupt lock shoulders which are engageable with a corresponding pair of oppositely facing lock shoulders in a landing receptacle in the well conduit, the locking device including a key retractor sleeve with cam surfaces thereon which coact with corresponding cam surfaces on the locking keys to retract the keys responsive to upward movement of the retractor sleeve. The device can be run into the well on a variety of running tools; it can be secured in its locked condition before running it into the well, in which case it will automatically lock in the landing receptacle upon entering the same, after which it can be unlocked only after shearing or otherwise rendering ineffective the securing means; or, it can be run into the well in its released condition, actuated to set condition after passing downwardly through the landing receptacle, and then lifted into the receptacle from below and becoming latched therein automatically upon reaching the proper position; and it can be installed in any selected one of a plurality of landing receptacles in a well conduit.

13 Claims, 5 Drawing Figures

LOCKING DEVICE FOR WELL TOOLS

BACKGROUND OF THE INVENTION

1. Field of the Invention

This invention relates to well tools and more particularly to devices for releasably anchoring well tools in well flow conduits.

2. Description of the Prior Art

Locking devices for anchoring well tools in flow conduits of wells have been used for many years. Many such locking devices carry keys or locking dogs which engage in specially prepared lock recesses or configurations formed in special landing receptacles or nipples made up in the tubing of these wells. Normally, a specially prepared bore wall, one made smooth by honing, is formed adjacent the lock recesses and generally immediately therebelow so that when the keys or dogs of the locking device are engaged in the locking recesses of the landing receptacle, resilient seals carried on the locking device will be sealingly engaged with the smooth bore wall immediately therebelow.

The following U.S. Patents disclose locking devices and/or landing receptacles therefor.

U.S. Pat. Nos. 2,673,614, 3,419,075, 4,043,392, 3,208,531, 3,472,070.

U.S. Pat. No. 2,673,614, issued to I. A. Miller on Mar. 30, 1954, discloses a locking device having locating keys which are engageable in a specially prepared landing receptacle which is connectable into the tubing string to form a part thereof. These locating keys are formed with a pair of external bosses, the lower end of the upper boss being provided with an abrupt downwardly facing locating shoulder which is engageable with a corresponding abrupt upwardly facing shoulder formed in the landing receptacle. This locking device is lowered into the well until the abrupt shoulders on the keys and the landing receptacle engage to arrest the downward movement of the device in the well conduit. The device is thereupon lifted to expand locking dogs on the device into locking engagement with a locking recess formed in the landing receptacle.

U.S. Pat. No. 3,208,531 issued to Jack W. Tamplen on Sept. 28, 1965. This patent discloses a locking device having keys configured similarly to those of the locking device of U.S. Pat. No. 2,673,614 just mentioned in that the key is configured with two external bosses, the upper one of which is provided at its lower end with an abrupt downwardly facing locating shoulder. This locating shoulder is engageable with a corresponding abrupt upwardly facing shoulder in a specially prepared landing receptacle to limit downward movement of the locking device in the flow conduit. In this particular device, however, a special running tool is utilized to lower the locking device completely through the landing receptacle and then to lift it upwardly therethrough, and this upward movement prepares the device for setting upon being lowered into the nipple the second time. In this case, the locating keys also serve as the locking keys.

U.S. Pat. No. 3,419,075 issued to Norman F. Brown on Dec. 31, 1968. This patent discloses a mechanism having locating keys configured much like the locating keys mentioned hereinabove but also having means thereon for retracting the keys to disengage their abrupt locating shoulder from a corresponding shoulder in the landing receptacle of the well tubing.

U.S. Pat. No. 4,043,392 issued to Imre I. Gazda on Aug. 23, 1977. This patent discloses a well tool having locating keys provided with several external bosses, and these keys are provided with two oppositely facing shoulders. The keys on this device serve the purpose of sliding a sleeve valve from its upper position to its lower position when the device is installed in the landing nipple connected immediately above the sliding sleeve valve. When the device is removed from the landing nipple, the keys will slide the sliding sleeve valve back to its upper position. In this particular case, the sliding sleeve valve controls admission of control fluid from a control line into the receptacle assembly so that control line pressure conducted from the surface can be used to control a surface controlled subsurface safety valve for protection of the well. The keys of this device are retracted in a manner similar to that taught in U.S. Pat. No. 3,419,075 mentioned hereinabove.

U.S. Pat. No. 3,472,070 issued to David V. Chenoweth on Oct. 14, 1969. This patent discloses a landing receptacle for well conduit, this receptacle being provided with an annular recess providing a pair of oppositely facing abrupt shoulders. A locking device is also disclosed having one set of keys pivotally mounted on the device so that one end of the keys projects outwardly beyond the periphery thereof and engages the recess to limit the movement of the locking device in one direction in the landing receptacle and a second set of keys pivotally mounted to the device and one end thereof which likewise projects outwardly beyond the periphery of the device and engages in the recess to limit movement of the device in the other direction in the landing receptacle. While the upper ends of the keys project outwardly, their inner ends project inwardly. A prong is moved into the bore of the device to engage the ends of the keys which project inwardly and thus pivot the keys to recess disengaging position. To limit movement of the device in the receptacle in either direction, the keys engage the abrupt shoulder either at the upper end or at the lower end of the recess.

None of the prior art devices with which applicant is familiar teaches a locking device for releasably anchoring a well tool in a well conduit, said locking device having locking keys with a pair of oppositely facing abrupt lock shoulders thereon engageable with a pair of corresponding oppositely facing abrupt lock shoulders in a landing receptacle of the well conduit, said locking device having a biasing member for biasing each locking key outwardly and having a mechanism including a retractor sleeve for retracting the locking keys to releasing position in response to upward movement of the retractor sleeve relative to said keys, there being coengageable camming surfaces on the keys and the retractor sleeve.

SUMMARY OF THE INVENTION

The present invention is directed to apparatus and methods for testing wells by controlling flow therefrom at a location above but adjacent the earth formation to be tested including opening the well to flow and then shutting it in, and sensing the well pressures below such control point during flowing and/or shut-in periods, the test apparatus including a landing receptacle in the well conduit and adjacent a well packer, and a test tool lowerable into the well on a flexible line and locked and sealed in the receptacle, the test tool and receptacle being used to open and close the well in response to tensioning and relaxing the flexible line. In one aspect of the invention, the receptacle is provided with lateral bypass flow ports which are opened and closed as a result of tensioning and relaxing the flexible line. The flexible line may be an electrical conductor line or a conventional wire line, and the pressure sensing device may be a recording pressure gauge or an electronic sensor which senses well pressures, generates electrical signals and sends them via the conductor line to the surface for processing and real-time recording and/or readout.

It is, therefore, one object of this invention to provide an improved locking device for well tools wherein the locking device is automatically locked in its receptacle upon being lowered to the proper position therein.

Another object of this invention is to provide such a locking device having locking keys thereon which are provided with a pair of oppositely facing abrupt shoulders for engaging a corresponding pair of oppositely facing abrupt shoulders in a landing receptacle to lock the device in the receptacle against displacement in either an upwardly or a downwardly direction.

A further object of this invention is to provide such a locking device which can be run with the mechanism secured in locked position by frangible means allowing the device to be installed in the landing nipple in locked and sealed condition and wherein the frangible means must be sheared or ruptured in order to actuate the locking mechanism to unlocked or released position for removal from the landing nipple.

A further object of this invention is to provide a locking device of the character set forth wherein retraction or release of the locking keys is positive.

Another object is to provide a locking device of the character described wherein the locking keys are carried in a recess on a mandrel and the end faces of the keys and the areas of the mandrel contacted by the end faces of the keys converge inwardly so that axial loading of the locking device results in a tendency for such inclined surfaces to force the keys outwardly into more intimate contact with the landing receptacle.

A further object is to provide such a device having such inclined mating surfaces on the ends of the keys and on the mandrel inclined at approximately 10 degrees from the horizontal (that is, about 80 degrees to the longitudinal axis of the device).

Another object is to provide a locking device of such character wherein such inclined load-bearing surfaces are planar.

Another object is to provide such a locking device wherein axial loading of the device is transferred from the mandrel to the locking keys through the contacting planar surfaces, and from the keys to the landing receptacle through the contacting abrupt shoulders on the keys and landing recep- tacle.

Another object is to provide such a locking device which, if desired, can be run in the released position so that the locking keys will not drag against the conduit wall during lowering of the locking device into the well.

A further object is to provide such a locking device which can be run and locked in any selected one of a plurality of spaced-apart landing receptacles in a well conduit.

Other objects and advantages will become apparent from reading the description which follows and from.-studying the accompanying drawing wherein:

DESCRIPTION OF THE PREFERRED EMBODIMENT

Figure 1:
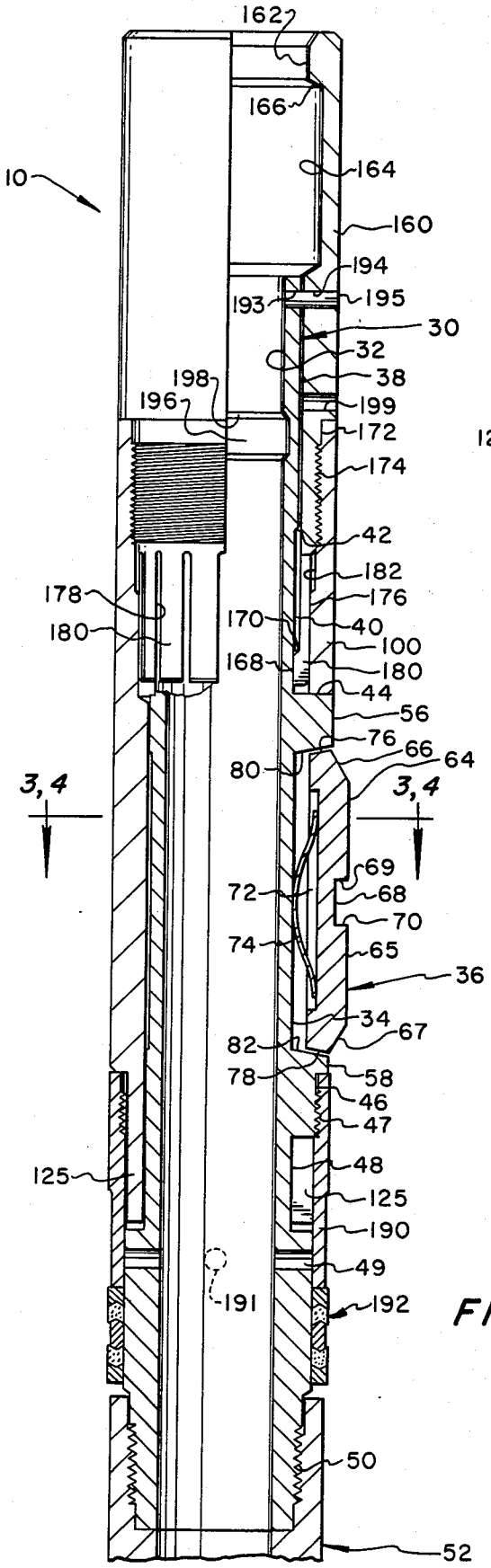
FIG. 1 is a longitudinal view, partly in section and partly in elevation, of a device constructed in accordance with the present invention.
Figure 2:
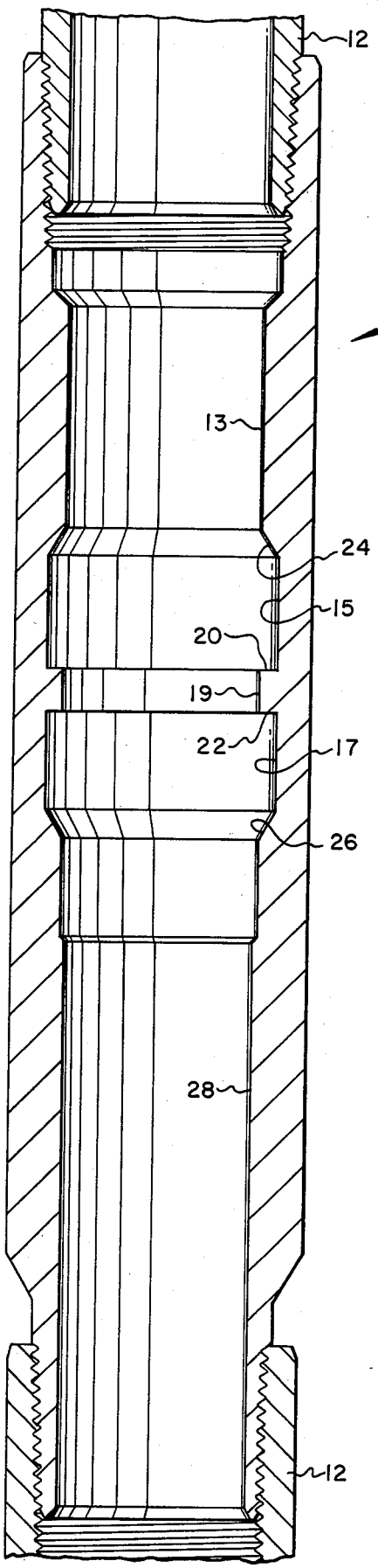
FIG. 2 is a longitudinal sectional view illustrating a landing receptacle suitable for receiving the locking device of FIG. 1.

Referring now to FIG. 1, it will be seen that the locking device of this invention is indicated generally by the numeral 10. Locking device 10 may be used to releasably anchor a well tool in a landing receptacle such as landing receptacle 11 seen in FIG. 2. Landing receptacle 11 is made up in a tubing string 12 at a desired location. If desired, a plurality of identical landing receptacles can be made up in the tubing string at spaced-apart selected locations. Landing receptacle 11 is provided with a bore 13 in the wall of which is formed a pair of internal annular recesses. The upper recess is indicated by the numeral 15 and the lower recess by the numeral 17. The upper and lower recesses are spaced apart a short distance, leaving an internal flange 19 therebetween, providing a pair of oppositely facing abrupt annular lock shoulders 20 and 22 as shown. The upper end of the upper recess is inclined upwardly and inwardly as at 24 while the lower end of the lower recess is correspondingly inclined inwardly and downwardly as seen at 26. Below the lower recess 26, a portion of bore 13 is reduced in diameter as at 28 and is provided with a smooth surface to be sealingly engaged by seal means carried on the locking device 10 as will be seen.

The device 10 has a main member or mandrel 30 having a central bore 32 for conducting fluid flow therethrough. Intermediate its ends, the mandrel 30 is provided with an external annular recess 34 in which a plurality of locking keys 36 are carried in a manner to be explained. The upper portion of the mandrel 30 is reduced in outside diameter as at 38 and is further reduced in outside diameter as at 40 providing a downwardly facing inclined annular shoulder 42 and an upwardly facing abrupt shoulder 44. Abrupt shoulder 44 is spaced a short distance above annular recess 34 in which tne keys 36 are carried.

Below tne recess 34, the mandrel is reduced in outside diameter as at 46 and threaded as at 47. The mandrel is formed with external annular recess 48 as shown, and tnis recess serves only as an expedient in the machining of the mandrel in a way that will be described later. Below the recess 48 is a shear pin hole 49, and the lower end of the mandrel is reduced in diameter and threaded as at 50 for attachment of a well tool 52, which well tool may be any suitable flow control device or the like such as a plug, safety valve, regulator, choke, equalizing sub, or the like.

Figure 3:
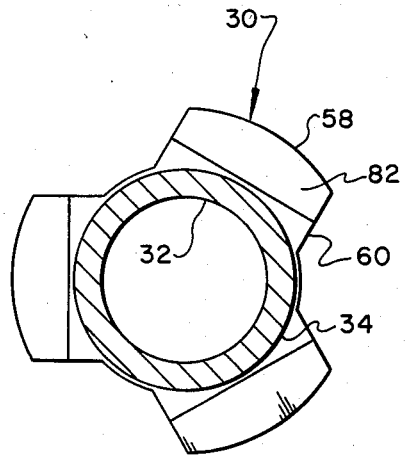
FIG. 3 is a cross-sectional view taken along line 3—3 of FIG. 1 but showing the mandrel only without the keys and springs.

It is seen tnat an external flange 56 is ieft remaining between the upper reduced portion of the mandrel and the annular recess 34, and another similar external flange 58 is left remaining between the recess 34 and the recess 48. A plurality of longitudinal grooves 60, as seen in FIG. 3, are formed in the flanges 56 and 58, and in the device illustrated there are three such longitudinal grooves 60 because three locking keys 36 are used.

It may now be seen that forming the longitudinal grooves 60 through the lower flange 58 can be accomplished with greater ease after the recess 48 therebelow has been formed. Other than this, the recess 48 has no purpose.

The locking keys 36 have their surface configured to correspond with the profile of the landing recesses formed in the landing receptacle 11. Thus the locking keys are formed with upper and lower bosses 64 and 65, respectively, which are suitably chamfered at their extremities as at 66 and 67. These chamfers serve as guide surfaces for guiding the keys past obstructions while the device is being lowered into or withdrawn from the well tubing and also for guiding the keys into and out of the landing receptacle. Between the upper and lower bosses 64 and 65 is a recess 68 providing upper and lower abrupt lock shoulders 69 and 70 which face in opposite directions. The profile of the key then is shaped and sized to correspond to the profile of the landing receptacle. It is readily seen that the locking keys 36 may move outwardly into the profile of the landing receptacle, the recess 68 accommodating the internal flange 19 of the landing receptacle so that the abrupt shoulders 69 and 70 of the key can engage the abrupt shoulders 20 and 22 of the receptacle. At this time, the external bosses 64 and 65 of the keys will be disposed in the recesses 15 and 17 of the landing receptacle. Thus it is obvious that the key cannot move out of the landing receptacle until it is retracted so that its abrupt shoulders 69 and 70 will not interfere with the abrupt shoulders 20 and 22 of the receptacle.

Each key is provided with a recess 72 on its inward side, and a flat or bow spring 74 is disposed in this recess and biases the keys outwardly away from the mandrel.

The upper and lower end faces 76 and 78 of the keys converge inwardly at an angle of about 10 degrees to the horizontal, and while the ends of the mandrel recess 34 also converge inwardly at an angle approximating 10 degrees, such surfaces are first formed frusto-conical in shape. The end faces of the keys are flat, that is, the surfaces 76 and 78 are planar surfaces. Accordingly, the three ears or lobes of the external flanges 56 and 58 between which the keys are confined are also provided with flat surfaces. These flat surfaces are indicated by the reference numerals 80 and 82 and are likewise inclined at a angle of approximately 10 degrees. These inclined surfaces on the ends of the keys and on the flanges provide for better, more intimate contact and provide greater bearing area, enabling the locking device 10 to withstand greater axial loads placed thereon as a result of pressure differentials acting across the device.

The tilting of the planar surfaces on the ends of the keys and on the mandrel serve not only to ensure that the keys will remain in their outer positions when under load because these tilted surfaces tend to cam the keys outwardly, but when the device is under an axial load, these tilted surfaces at the ends of the keys direct the load toward the abrupt shoulders in the landing receptacle. Thus the load is transmitted through the mated planar surfaces from the mandrel to the key, and from the key to the landing receptacle through the mated abrupt lock shoulders of the keys and the receptacle. Because of this, the mandrel and keys can withstand a tremendous load in either an upward or a downward direction.

Figure 5:
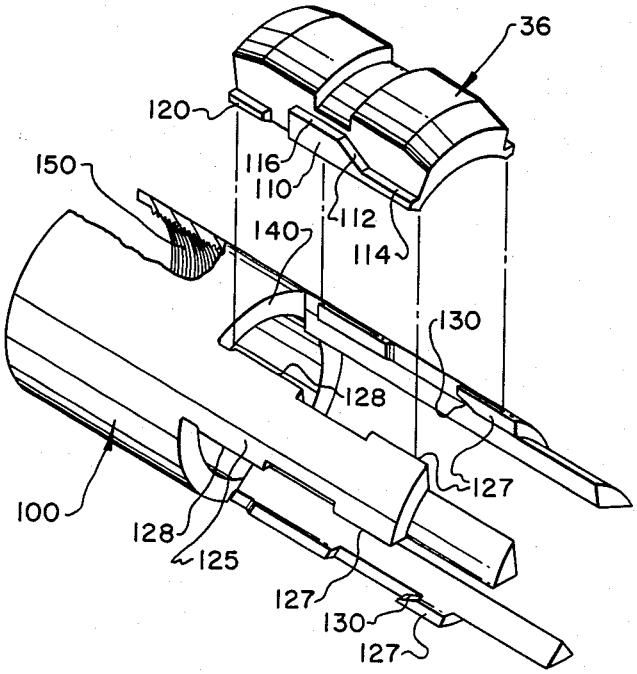
FIG. 5 an exploded view in perspective showing the relationship between the keys and the longitudinally movable key retracting sleeve for disengaging the keys from the landing receptacle.

In order to release the keys from locking engagement in the landing receptacle, they must be retracted. The mechanism for retracting the keys to releasing position will now be explained. A retractor sleeve is indicated generally by the reference numeral 100. In FIG. 1, one of the keys 36 is shown so that its relation to the retractor sleeve may be seen. As seen in FIG. 5, each key is provided with lateral wings or ears 110, each having an upper surface providing a cam surface 112 which leads upwardly from a lower ramp 114 to a higher ramp 116. In addition, each key is provided with a pair of lateral tabs 120.

Figure 4:
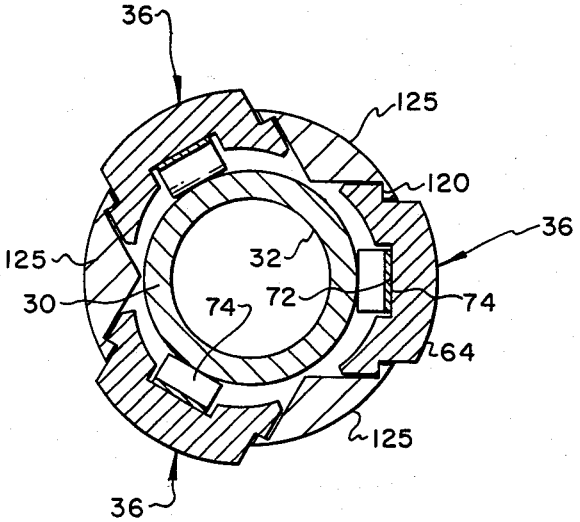
FIG. 4 is a cross-sectional view taken along line 4—4 of FIG. 1.

The key retractor sleeve 100 is provided with three fingers 125, and these fingers are disposed between the keys as is clearly shown in FIG. 4. When the key retractor and the keys are assembled on the mandrel as shown in FIG. 1, the keys are held in position by ears on the fingers, overriding the wings and tabs on the keys. Thus, it will be seen that each finger 125 is provided with a pair of lower wings 127 and a pair of upper wings 128. The key retractor sleeve 100 is slidably mounted upon the mandrel with its fingers 125 disposed between the keys. When the retractor sleeve is in its lower position shown in FIG. 1, the keys are free to be moved outwardly under the bias of bow spring or flat spring 74, and in this position, the wings 127 of the fingers are in a position to engage the lower ramps 114 of the keys and thus limit outward movement of the keys. The tabs at the upper ends of the keys are engaged by the upper wings 128 of the fingers to also limit outward movement of the keys. When the key retractor sleeve is moved upwardly relative to the keys, the cam surface 130 at the upper inner corner of the lower wings 127 engages the cam surface 112 on the wings 110 of the keys and coacts therewith to cam the keys inwardly to released position in which the upwardly facing abrupt shoulder 70 on the keys will clear the downwardly facing abrupt shoulder 22 of the landing receptacle and thus permit the locking device 10 to be moved upwardly out of the landing receptacle for removal from the well. When the retractor sleeve is again moved to its lower position shown in FIG. 1, the keys will again be free to be moved to their outer or expanded position under the bias of spring 74. Of course, in this position, the keys are free to be moved inwardly should their guide surfaces 66 or 67 meet with an obstruction while the device is moving through the well tubing.

Downward movement of the key retractor sleeve 100 upon the mandrel is limited by engagement of the retractor sleeve's flat surface 140, formed between the upper ends of the fingers, with the upwardly facing shoulder 44 on the upper side of the mandrel flange 56. Upward movement of the retractor sleeve 100 relative to the mandrel is limited in a manner now to be described.

The retractor means includes the retractor sleeve 100 and the fishing neck 160. The upper end of the tubular retractor sleeve as seen in FIG. 5 is internally threaded as at 150 for attachment to the lower end of the fishing neck 160 which is the uppermost piece on the device 10 as seen in FIG. 1.

The fishing neck 160 has a bore 162 which is enlarged as at 164 to provide a downwardly facing shoulder 166 for engagement by a suitable fishing or running tool as will be explained later. The bore 162 is reduced in diameter as at 168, thus providing an upwardly facing shoulder 170 as shown. The outside diameter of the fishing neck 160 is reduced as at 172 and is externally threaded as at 174 so that the fishing neck can be screwed into the upper end of the retractor sleeve 100. Below the thread 174, the fishing neck 160 is further reduced in diameter as at 176, and a plurality of downwardly opening longitudinal slots 178 are formed in the lower end of the fishing neck to provide a plurality of downwardly extending collet fingers 180, each having an inner boss as shown. When assembled as shown in FIG. 1, upward movement of the fishing neck and the retractor sleeve attached thereto is limited by engagement of the upwardly facing shoulder 170 on the boss of the collet fingers with the downwardly facing shoulder 42 on the mandrel. In assembling the fishing neck 160 to the retractor sleeve 100, the retractor sleeve must be in its lower position shown in FIG. 1. The lower end of the fishing neck may then be slipped over the upper end of the mandrel 30 and slid downwardly, telescoping the lower end of the fishing neck into the upper end of the retractor sleeve. The collet fingers and their bosses will spread slightly and slide over the upper portion of the mandrel and will snap into the reduced diameter portion 40 thereof, after which the thread 174 can be made up. To aid in assembling this portion of the tool, the retractor sleeve 100 is provided with a counterbore 182 to allow the lower ends of the collet fingers to move downwardly sufficiently far tnat their upwardly facing shoulders 170 will pass beyond the downwardly facing shoulder 42 of the mandrel.

Thus assembled, the keys 36 will be retracted in response to upward movement of the fishing neck and retractor sleeve relative to the mandrel and keys, and when the fishing neck and retractor sleeve are in their lower positions shown in FIG. 1, the keys will be free to spring inwardly, although the spring will bias them towards their expanded positions shown in FIG. 1.

A retainer sleeve 190 surrounds the lower portion of the mandrel and is secured thereto by thread 47. A packing ring set 192 surrounds the mandrel therebelow, and the upper end of the packing ring set abuts the lower end of the retainer sleeve 190 as shown. The packing ring set 192 is secured in place by the upper end of the flow control device 52. Alternatively, it could be held in place by some other means such as a nut if desired.

A transverse hole 49 is formed in the mandrel to receive a shear pin (not shown) by which the device 10 is attached to a particular type of running tool. This shear pin hole is clearly shown to be covered by the retainer sleeve 190. Thus, no screws are needed to hold a shear pin in place in this hole. To facilitate installing a shear pin in hole 49 and in removing it therefrom, the retainer sleeve 190 may be provided with a pair of opposed access holes 191, shown in dotted lines. These holes are located about 90 degrees from shear pin hole 49. Thus, the retainer sleeve 190 must be unscrewed about 90 degrees to align the access holes 191 therein with the shear pin hole 49 in the mandrel 30.

When the locking device 10 is disposed in the landing receptacle 11 and its locking keys 36 are engaged in the lock recesses of the landing nipple, thus securing the locking device in place so that it cannot move upwardly or downwardly out of the nipple, the packing ring set 192 will be sealingly engaged with the smooth bore 28 of the landing receptacle to prevent leakage of well fluid therepast. This then directs all flow through the bore 32 of the locking device and also through the flow control device 52.

To install the device in the well, a suitable running tool is used. This running tool with the locking device 10 attached thereto would be lowered into the well on a string of tools by a flexible wireline or the like. With this locking device 10, more than one type of running tool may be used.

If the well tuoing contains only one landing receptacle 11, or if it is desired to install the locking device 11 in the upper one of a plurality of landing receptacles 11, the locking device 10 may be run into the well with the retractor sleeve in its lower position as shown in FIG. 1. The retractor sleeve may be releasably secured in its lower position by shear pin 195 disposed in aligned apertures 194 and 193 in the fishing neck 160 and in the mandrel 30, respectively as shown in FIG. 1. If this is the case, the running tool may comprise a simple prong having an external flange providing a downwardly facing surface near its upper end. The prong would be secured to the locking device by placing a shear pin (not shown) through the running prong and having its ends disposed in the shear pin hole 49 located just above the packing ring set 192. In this position, the downwardly facing shoulder on the prong should be in position to abut the extreme upper end of the fishing neck 160. The device is lowered into the well with the keys 36 dragging against the inner wall of the well tubing since these keys would be freely pressed outwardly by the springs 74. When the locking device 10 would be inserted into the landing nipple, the keys would spring outwardly upon becoming aligned with the locking profile of the landing nipple so that the downwardly facing shoulder 69 on the key would engage the upwardly facing shoulder 20 of the landing receptacle and arrest the downward movement of the locking device. In this position, the packing ring set 192 would be sealingly engaged with the smooth bore 28 of the receptacle, and tne device would be locked in place. It could not move downwardly because of downwardly facing shoulder 69 of the key and could not move upwardly because of the upwardly facing shoulder 70 of the key. Jarring impacts delivered by manipulation of the wireline tools would then be directed upwardly, and these upward impacts would cause the pin disposed in shear pin hole 49 of the device 10 to fail or shear, thus releasing the running tool from the device for withdrawal from the well tubing.

A shear pin 195 is placed in aligned shear pin holes 193 and 194 in the mandrel 30 and the fishing neck 160, respectively, to secure the fishing neck to the mandrel at its lower position thereon, in which position the keys 36 will be in their outer, non-retracted position, all as shown in FIG. 1.

To withdraw the locking device 10 from the well, a suitable fishing tool such as the type GS fishing tool available from Otis Engineering Corporation, Dallas, Tex., would be run into the well on a string of wireline tools, and this fishing tool would engage the internal downwardly facing shoulder 166 near the upper end of the device, and upward jarring impacts tending to lift the fishing neck and retractor sleeve would soon shear the shear pin 195 and would lift the retractor sleeve, thus retracting the keys as before explained and releasing them from the landing receptacle so that the device could be lifted upwardly out of the receptacle and withdrawn from the well.

If the locking device 10 is to be installed in a selected one of a plurality of identical landing receptacles 11 which are made up in the tubing string at various locations therein, the locking device 10 may be run on a more sophisticated running tool such as the type "X" running tool which also is available from Otis Engineering Corporation, Dallas, Texas, and which is structured very much like the running tool disclosed in U.S. Pat. No. 3,208,531, supra. The type "X" running tool has a prong which would be pinned with a shear pin placed in the shear pin hole 49, and it also has a pair of dogs which would support the fishing neck 160 in its upper position, that is, with the keys 36 retracted. The keys therefore would not drag against the wall of the tubing on their downward trip into the well but would pass through any of the landing receptacles 11 that they encountered. When the locking device 10 reached a level just below the landing receptacle 11 in which the device is to be installed, downward travel of the tool string would be stopped, and the tools would then be lifted to lift the locking device 10 up through that selected landing receptacle. Upon encountering the landing nipple of the landing receptacle 11 from below, the type "X" running tool would sense the landing receptacle as taught in U.S. Pat. No. 3,208,531 and would cause the dogs supporting the fishing neck to release their engagement, and the fishing neck would be moved to its lower position shown in FIG. 1. When the locking device 10 would then be lifted sufficiently far for the keys to become aligned with the locking profile in the landing receptacle 11, the keys would spring outwardly and engage the upwardly and downwardly facing abrupt lock shoulders 20 and 22 therein and would arrest upward movement of the locking device. The locking device at this time would be securely locked in the landing receptacle, and upward jarring impacts of the wireline tools could then be utilized to shear the pin disposed in shear pin hole 49 and thus release the running tool from the device so that the wireline tools could be removed from the well.

If the locking device 10 is to be run in its locked position shown in FIG. 1 and the type of tool formerly described were not available, it could be run on a running tool known as the type "W" running tool available from Otis Engineering Corporation, Dallas, Tex. The type "W" running tool engages the upper end of the fishing neck and has collet fingers with external bosses thereon which extend downwardly into the device 10, and these external collet bosses would be engaged in the internal recess 196 which provides the downwardly facing shoulder 198 in the upper portion of the mandrel 30. In this case, the tool string and running tool would be used to insert the locking device 10 in the landing receptacle 11, and after it were locked in position, jarring impacts could be delivered through manipulation of the wireline tools to shear a pin in the running tool and cause the running tool to be released from the locking device 10 for withdrawal from the well.

Should it be desirable to secure the retractor sleeve 100 in its upper position, the fishing neck 160 may be provided with a shear pin hole 199 which would receive the outer end of a shear pin such as shear pin 195.

Thus, it has been shown that the locking device of this invention fulfills all of the objects set forth early in this application, it being understood that the device may be run into the well with the keys either retracted or in their expanded positions; that any selected one of a plurality of running tools may be used to install the device in a suitable receptacle; that the device will withstand tremendous axial loads; that such axial loads are not transferred from the keys to a key cage, as is so often the case, but are transferred by the keys directly to the landing receptacle as before explained; and that the device locks readily and securely, yet is easy to release and withdraw from its receptacle.

The foregoing specification and drawings are herein presented as an explanation only, and various changes in sizes, shapes, and arrangements of parts may be had by those skilled in the art without departing from the true spirit of this invention.

I claim:

1. A device for releasably locking a well tool in a receptacle in a well conduit, said receptacle having a pair of oppositely facing abrupt shoulders therein, said device comprising:

a. tubular mandrel means having means on the lower end thereof for attachment of a well tool;

b. locking keys carried on said mandrel means, said locking keys having a pair of oppositely facing abrupt shoulders engageable with said oppositely facing abrupt shoulders of said receptacle;

c. means biasing said keys outwardly toward a position of engagement with said abrupt shoulders of said receptacle;

d. key retraction means carried on said mandrel means and being movable longitudinally relative thereto between upper and lower positions, said retraction means having camming surfaces thereon engageable with corresponding camming surfaces on said locking keys for moving said keys to retracted position responsive to upward movement of said retraction means relative to said mandrel means; and e. resilient seal means on said mandrel means sealing between said mandrel means and said landing recep- tacle.

2. The device of claim 1, wherein said locking keys are carried between upper and lower walls of an external annular recess of said mandrel, and the end faces of at least one end of said locking keys and at least one wall defining the upper or lower limit of said mandrel recess are tilted such that the end faces of the keys and the walls of said recess are convergent inwardly.

3. The device of claim 2, wherein said mandrel means has its upper portion reduced in outside diameter providing an upwardly facing annular shoulder spaced above said external annular recess, said mandrel means is formed with external longitudinal grooves extending upwardly from below said external annular recess and passing through said annular upwardly facing shoulder provided by said upper reduced portion, said key retraction means being tubular and slidably disposed about said upper reduced portion of said mandrel means and having dependent finger means thereon extending downwardly in said longitudinal grooves and between said locking keys, said key retraction means having lateral camming surfaces formed on the fingers thereof for coacting with lateral camming surfaces formed on said locking keys for retracting said locking keys upon upward relative movement of said key retraction means.

4. The device of claim 3, wherein the end faces of the locking keys and the shoulders defining tne upper and lower limits of said external annular recess of said mandrel are planar.

5. The device of claim 4, wherein said upper and lower planar surfaces on said locking keys and said mandrel means converge inwardly at an angle approximating 10 degrees.

6. The device of claim 5, wherein each said iockin9 key is provided with an external boss having cam surfaces at its opposite ends which converge outwardly and with a transverse groove intermediate its ends which provides a pair of oppositely facing abrupt lock shouders.

7. The device of claim 6, wherein downward movement of said key retraction means is limited by engagement of first shoulder means thereon with said upwardly facing shoulder provided by said upper reduced portion of said mandrel means, and upward movement of said key retraction means is limited by engagement of second shoulder means carried thereon with a downwardly facing shoulder formed on said mandrel means at a location spaced above said upwardly facing shoulder.

8. The device of claim 7, wherein said key retraction means includes a fishing neck portion and a sleeve portion secured together in axial alignment, said fishing neck being formed with shoulder means near its upper end engageable by a pulling tool and with dependent collet fingers on its lower end, said collet fingers having internal bosses on their lower ends providing upwardly facing shoulder means engageable with said downwardly facing shoulder of said mandrel means to limit upward movement of said key retraction means on said mandrel means.

9. The device of claim 8, wherein said mandrel means is provided with means for attachment of a running tool.

10. The device of claim 9 including means for releasably securing said key retraction means in its lower position upon said mandrel means, said securing means being releasable to permit said key retraction means to be moved from its lower to its upper position to retract said locking keys.

11. The device of claim 10, wherein said means for releasably securing said key retraction means in its lower position upon said mandrel means includes a shear pin disposed in aligned shear pin holes in said mandrel and said key retraction means.

12. The device of claim 9, including means for releasably securing said key retraction means in its upper position upon said mandrel means holding said keys retracted, said securing means being releasable to permit said key retraction means to be moved from its upper to its lower position to permit said locking keys to move to expanded position.

13. The device of claim 12, wherein said means for releasably securing said key retraction means in its lower position upon said mandrel means includes a shear pin disposed in aligned shear pin holes in said mandrel and said key retraction means.

* * * * *

UNITED STATES PATENT AND TRADEMARK OFFICE

CERTIFICATE OF CORRECTION

PATENT NO. : 4,540,048

DATED : September 10, 1985

INVENTOR(S) : Imre I. Gazda

It is certified that error appears in the above—identified patent and that said Letters Patent is hereby corrected as shown below:

For the paragraph beginning at Column 2, line 57, and running through Column 3, line 10, read:

--The present invention is directed to a device for releasably locking a well tool in a receptacle in a well conduit, the receptacle providing a pair of oppositely facing lock shoulders and a seal bore spaced therefrom, the locking device having a tubular mandrel on which locking keys are carried, the locking keys having a pair of oppositely facing lock shoulders engageable with the lock shoulders in the receptacle, the keys being spring-pressed outwardly at all times but are retractable to disengaged position by a member slidably mounted about the mandrel, there being coengageable camming surfaces on the keys and the slidable member, there further being one or more seal members on the tubular mandrel which will make sealing contact with the seal bore of the receptacle. In one form of the invention, the device is pinned in the locked position prior to installation and this

UNITED STATES PATENT AND TRADEMARK OFFICE

CERTIFICATE OF CORRECTION

PATENT NO. : 4,540,048

DATED : September 10, 1985

INVENTOR(S) : Imre I. Gazda

It is certified that error appears in the above—identified patent and that said Letters Patent is hereby corrected as shown below:

pin must be sheared in order to unlock the device for removal from its landing nipple.—

Col. 3, line 55, for "recep-tacle" read —receptacle—.

Col. 4, line 58, for "tne" read —the—; line 61, for "tnis" read —this—.

Col. 5, line 1, for "tnat" read —that—; same line, for "ieft" read —left—.

Col. 7, line 33, for "tnat" read —that—.

Col. 8, line 13, for "tuoing" read —tubing—.

Same Col., line 42, for "tne" read —the—.

Col. 10, line 41, for "recep-tacle" read —receptacle—.

Same Col., line 68, for "tne" read —the—.

Col. 11, line 7, for "iockin9" read —locking—.

Signed and Sealed this

Twenty-second Day of September, 1987

*Attest:*

DONALD J. QUIGG

*Attesting Officer* *Commissioner of Patents and Trademarks*